United States Patent [19]

Roberts et al.

[11] 4,040,061

[45] Aug. 2, 1977

[54] BROADBAND CORRUGATED HORN ANTENNA

[75] Inventors: Craig G. Roberts; Samuel Chung-Shu Kuo, both of Saratoga, Calif.

[73] Assignee: GTE Sylvania Incorporated, Mountain View, Calif.

[21] Appl. No.: 691,322

[22] Filed: June 1, 1976

[51] Int. Cl.[2] ..... H01Q 13/02

[52] U.S. Cl. ..... 343/786; 333/98 M

[58] Field of Search ..... 343/786, 854; 333/98 M

[56] References Cited

U.S. PATENT DOCUMENTS

| | | | |
|---|---|---|---|
| 3,413,642 | 11/1968 | Cook | 343/786 |
| 3,754,273 | 8/1973 | Takeichi et al. | 343/786 |

*Primary Examiner*—Eli Lieberman

*Attorney, Agent, or Firm*—John F. Lawler

[57] ABSTRACT

Broadband (8–18 GHz) operation of a horn antenna with broadband corrugations is achieved by provision of dissipative $TM_{11}$ mode suppressor means in the input waveguide feed to the horn. For a conical horn the input feed waveguide is circular and the mode suppressor means comprises a pair of axially extending diametrically spaced conductive wires or rods supported within the waveguide in dielectric foam, or alternatively, a cylindrical resistance card similarly supported coaxially with the waveguide. For a square corrugated horn of this type, the input waveguide is square and the mode suppressor means comprises a pair of parallel spaced axially extending resistance cards located in the planes of the magnetic field nulls in the waveguide.

8 Claims, 5 Drawing Figures

BROADBAND CORRUGATED HORN ANTENNA

BACKGROUND OF THE INVENTION

This invention relates to antennas and more particularly to a broadband horn antenna useful for direction finding or for feeding a reflector.

The corrugated horn antenna, known also as the scalar horn antenna, is a conical or square horn antenna with coaxial corrugations or slots formed in the horn wall along axially spaced planes that are transverse to the axis of the horn. This antenna has many advantages including a circularly symmetrical radiation pattern essentially free of side lobes and a substantially constant beamwidth. The useful bandwidth of this corrugated horn, however, is approximately 1.7:1 which limits its applications. For example, there are microwave receivers currently available which may be tuned over frequency ranges of 8–12 GHz and 12–18 GHz, respectively, so that two receivers are employed to cover the 8 to 18 GHz band. It is advantageous for many reasons to have two such receivers share a single antenna but to accomplish this, the antenna must have an operating bandwidth of at least 2.25:1, i.e., it must have acceptable performance characteristics over this band.

Efforts to extend the bandwidth of the corrugated horn antenna have included forming the horn with broadband slots such as partially dielectrically loaded slots, tapered slots, or ridge loaded slots, the latter being described in a paper entitled "The Ring Loaded Corrugated Waveguide" by Y. Takeichi et al published in IEE Transactions on Microwave Theory and Techniques, December 1971, pages 947–950. While such horn constructions have resulted in some bandwidth improvement, the radiation pattern nevertheless still deteriorates at the upper end of 8 to 18 GHz band so that the antenna is unacceptable for use in high performance receiving systems operating over this band.

OBJECTS AND SUMMARY OF THE INVENTION

A general object of this invention is the provision of a horn antenna having a useful operating bandwidth of at least 2.25:1.

A further object is the provision of a corrugated horn antenna capable of operating over a band of 8–18 GHz with minimum variation in the E and H-plane beamwidth, minimum beamwidth variations as a function of frequency and low voltage standing wave ratio (VSWR).

These and other objects of the invention are achieved with a broadband corrugated horn antenna that is fed by a waveguide in which a $TM_{11}$ mode suppressor means is disposed. This is based on the discovery that in addition to the effect of capacitive bandwidth of the horn corrugations on antenna operating frequency range, the generation in the horn of modes of higher order than the fundamental hybrid mode is also a bandwidth limiting factor because excitation of such higher order modes in the horn produces significant radiation pattern deterioration. The presence of conventional higher order modes in the input feed waveguide tends to couple to these higher order hybrid modes in the horn and so additional bandwidth extension sufficient to permit operation over the critical 8–18 GHz band is attained by suppression of such higher order modes in the input feed waveguide. The suppressor means comprises straight wire conductors or cylindrical resistance card for a conical horn and resistance cards for a square horn.

DESCRIPTION OF PREFERRED EMBODIMENT

Figure 1:
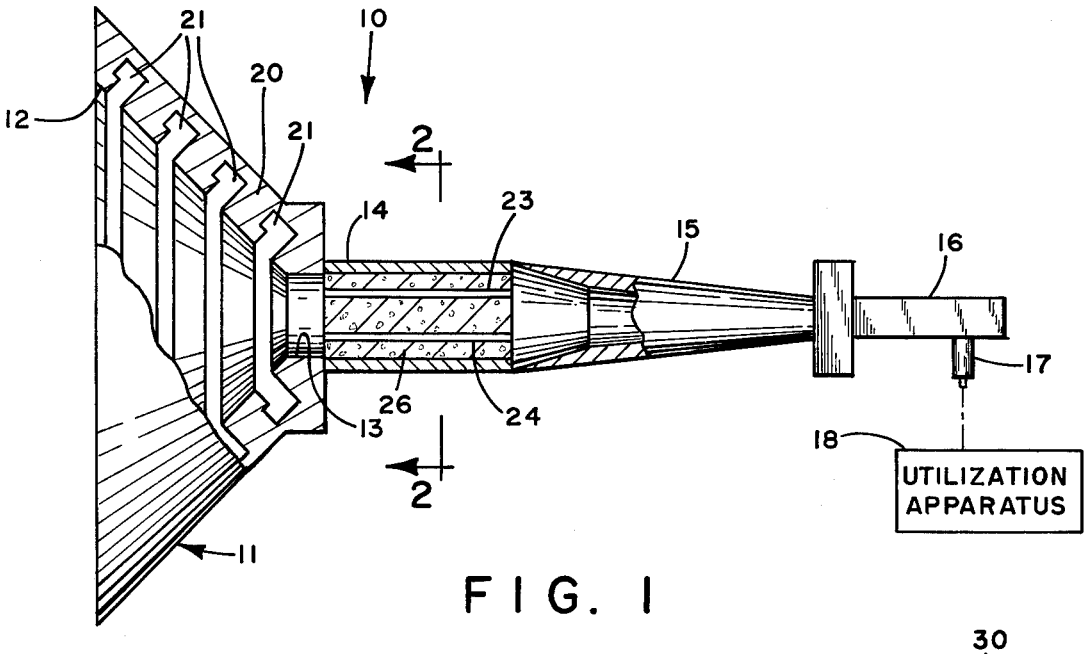
FIG. 1 is an elevation partly in section of a conical horn antenna system embodying the invention.

Referring now to the drawings, an antenna system 10 embodying the invention is shown in FIG. 1 and comprises a conical horn 11 with a circular aperture 12 and a circular feed port 13, a cylindrical waveguide 14 connected to port 13, a broadband tapered ridged circular-to-rectangular transition waveguide 15, a ridged rectangular waveguide 16 connected to transition waveguide 15 and a coaxial cable 17 connecting waveguide 16 to utilization apparatus 18. By way of example, apparatus 18 may comprise two receivers tunable over frequency ranges of 8–12 GHz and 12–18 GHz, respectively.

Horn 11 has an outwardly flared wall 20 with a plurality of coaxial axially spaced annular slots or corrugations 21 formed on its inner surface, the cross-sectional profile of each slot resembling a ring loaded or ridged configuration. The effect of such ring loading or ridging is to extend the capacitive bandwidth of the corrugations so that the depth of each remains between one-quarter and one-half wavelength over the operating frequency range. Other techniques for similarly extending the bandwidth of the horn are the use of partial dielectrically loaded slots or tapered slots.

Extension of the horn bandwidth by shaping the corrugations therein, however, is insufficient to permit operation of the system over the 8 to 18 GHz because excitation of hybrid modes in the horn at the upper end of that band cause an unacceptable deterioration in the radiation pattern. In order to prevent such pattern deterioration, mode suppressor means comprising straight conductors 23 and 24 are supported in parallel axially extending relation in cylindrical waveguide 14 throughout its length. Conductors 23 and 24, preferably made of brass, are disposed in the central plane of the waveguide coincident with the central plane of transition waveguide 15 containing the electric field vector. The space between conductors is approximately one-half the inside diameter of waveguide 15 and each is spaced the same distance from the waveguide wall. In order to support conductors 23 and 24 within waveguide 15, a cylinder 26 of suitable wave-transparent dielectric such as polystyrene foam bored to receive the conductors is snugly inserted in the waveguide.

Figure 2:
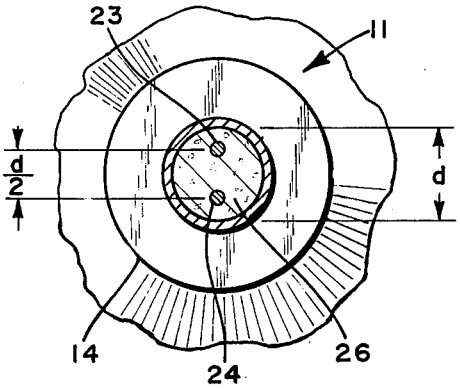
FIG. 2 is a transverse section taken on line 2—2 of FIG. 1.

An antenna system embodying the invention illustrated in FIGS. 1 and 2 having the following characteristics was built and successfully operated:

| | |
|---|---|
| Horn | |
| Type | conical |
| Flare (Cone) angle | 76° |
| Corrugations | ring loaded |

-continued

| | |
|---|---|
| Length | 5.0 cm. |
| Waveguide 14 | |
| Type | cylindrical |
| Diameter | 2.67 cm. |
| Length | 3.56 cm. |
| Conductors 23, 24 | |
| Material | brass |
| Diameter | .22 cm. |
| Length | 3.56 cm. |
| Dielectric | polystyrene foam |
| Transition waveguide | |
| Length | 11.5 cm. |
| Waveguide 16 | Microwave Research Corporation WD-750 |
| Operating frequency | 8-18 GHz |
| VSWR | 1.6 |
| Insertion loss (conductors 23,24) | negligible |

Figure 3:
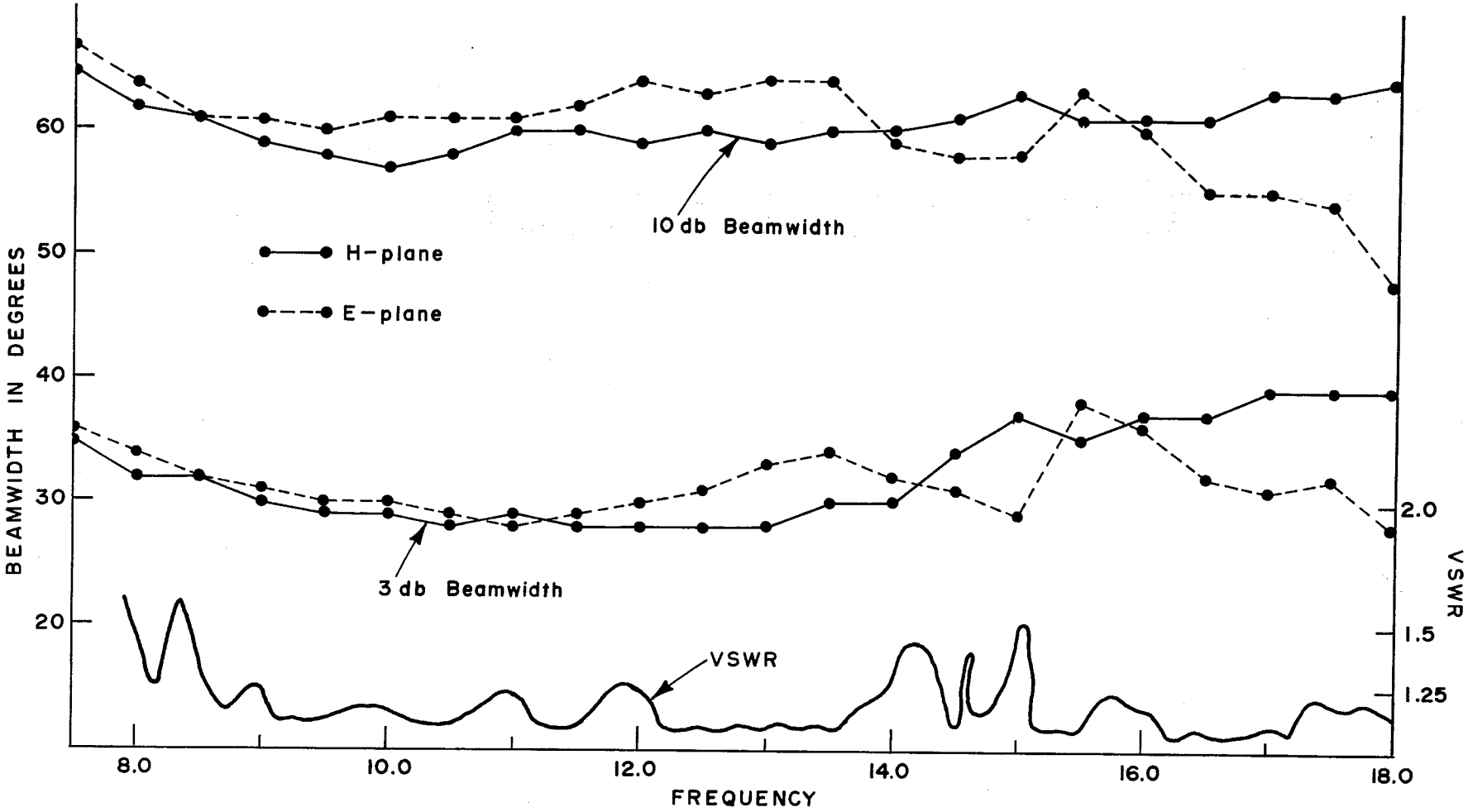
FIG. 3 is a plot of actual performance of a conical horn antenna embodying the invention.

FIG. 3 is an actual plot of the radiation pattern and VSWR measurements of the above antenna over the frequency band of interest. It will be noted that both the 3 db and 10 db beamwidth plots (E and H planes) are fairly consistent as a function of frequency.

Figure 4:
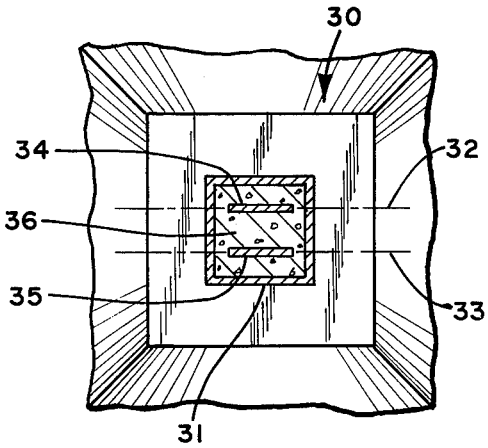
FIG. 4 is a section similar to FIG. 2 of a square horn antenna system showing resistance card mode suppressors in the square waveguide feed section.

The invention may also be practiced with similar advantage with a square horn 30, shown partially in FIG. 4, connected by a square waveguide 31 to a ridged rectangular to square transition waveguide, not shown, otherwise similar to transition waveguide 15. The field distribution in square waveguide 31 is such that the magnetic field is zero along spaced transverse planes 32 and 33 so that the higher order mode suppressors may take the form of flat resistance cards 34 and 35 supported by dielectric 36 and extending in planes 32 and 33, respectively, for the length of waveguide 31. The electric field vector in waveguide 31 is normal to planes 32 and 33 so that insertion loss due to the resistance cards is negligible.

Figure 5:
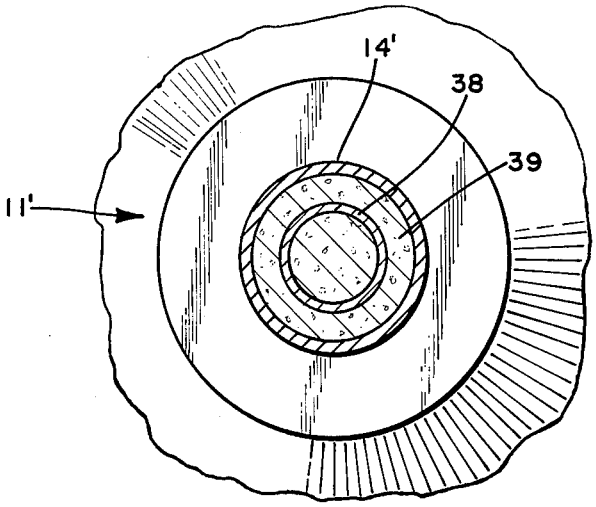
FIG. 5 is an enlarged section similar to FIG. 2 showing another shape of resistance card useful in the practice of the invention.

The invention may also be practiced with a conical horn 11' by a cylindrically shaped resistance card 38, see FIG. 5, supported coaxially in cylindrical feed waveguide 14' by a wave transparent dielectric 39 in radially spaced relation to the waveguide wall. The diameter of card 38 is approximately 60% of the inside diameter of the waveguide and typically is made of metallized Mylar about 0.005 cm. thick. Card 38 introduces a small insertion loss of about 1.5 db in the system which otherwise has substantially the same operating characteristics as the system of FIGS. 1 and 2.

What is claimed is:

1. An antenna system comprising a corrugated horn antenna having an inner surface formed with broadband slots and having an aperture with a predetermined shape and a correspondingly shaped feed port, waveguide means connected to said port, said waveguide means comprising a ridged rectangular waveguide, a tapered transition waveguide connected to said ridged waveguide, and an intermediate waveguide connected between said transition waveguide and the feed port of said horn, said intermediate waveguide having the same cross-sectional shape as said feed port, and hybrid mode suppressor means disposed within said intermediate waveguide whereby to suppress hybrid wave modes in said horn and correspondingly increase its operating bandwidth.

2. The antenna system according to claim 1 in which said horn is conical and said intermediate waveguide is cylindrically shaped, said mode suppressor means comprising at least two diametrically spaced conductive rods extending parallel to the direction of wave propagation in said intermediate waveguide.

3. The antenna system according to claim 2 in which the spacing between said rods is equal to approximately one-half the inside diameter of said intermediate waveguide.

4. The antenna system according to claim 1 in which said horn is conical and said waveguide is cylindrically shaped, said suppressor means comprising a cylindrical resistance card coaxially supported in said waveguide in radially spaced relation to the waveguide wall.

5. The antenna system according to claim 4 in which the diameter of said card is approximately 60% of the inside diameter of said cylindrical waveguide.

6. The antenna according to claim 1 in which said horn and said intermediate waveguide have square cross-sectional shapes, said mode suppressor means comprising at least two spaced resistance cards extending parallel to each other in the direction of wave progagation.

7. The antenna system according to claim 6 in which said resistance cards are in planes perpendicular to the electric field vector of the waves propagating in said intermediate waveguide and at the null points, respectively, of the magnetic field therein.

8. A broadband antenna system comprising a corrugated conical horn antenna having a circular aperture and a circular feed port, said horn having an inner surface formed with a plurality of ring loaded axially spaced coaxial slots, a circular waveguide connected to the side of said port opposite from said aperture, hybrid mode suppressor means in said circular waveguide comprising a pair of parallel diametrically spaced electrical conductors extending within said circular waveguide for its length, said conductors being equally radially inwardly spaced from the wall of said waveguide and being spaced apart by approximately one-half the diameter of said waveguide, means to support said conductors in said waveguide comprising a dielectric material transparent to waves propagating in said waveguide, a ridged rectangular waveguide, a circular-to-rectangular transition waveguide connecting said circular waveguide to said ridged waveguide, and a coaxial feed line connected to said ridged waveguide.

* * * * *